US006241782B1

(12) United States Patent
Vande Haar

(10) Patent No.: US 6,241,782 B1
(45) Date of Patent: Jun. 5, 2001

(54) HORIZONTAL AXIS WASHING MACHINE INCORPORATING FLUSH TUMBLE CYCLE

(75) Inventor: Evan R. Vande Haar, Pella, IA (US)

(73) Assignee: Maytag Corporation, Newton, IA (US)

( * ) Notice: Subject to any disclaimer, the term of this patent is extended or adjusted under 35 U.S.C. 154(b) by 10 days.

(21) Appl. No.: 09/697,168

(22) Filed: Oct. 27, 2000

Related U.S. Application Data

(60) Provisional application No. 60/163,805, filed on Nov. 5, 1999.

(51) Int. Cl.[7] ..... D06F 33/02
(52) U.S. Cl. ..... 8/159; 68/12.12
(58) Field of Search ..... 8/159; 68/12.12

(56) References Cited

U.S. PATENT DOCUMENTS 2,968,174 1/1961 Bell et al. .
5,860,300 1/1999 Valent .
5,881,579 3/1999 Ellingson .
5,890,247 4/1999 Erickson et al. .

*Primary Examiner*—Philip R. Coe
(74) *Attorney, Agent, or Firm*—Diederiks & Whitelaw PLC

(57) ABSTRACT

An overall washing operation for a horizontal axis washing machine includes at least one washing cycle and numerous rinse and spin cycles, with at least a portion of one of the rinse cycles being performed at an increased rotational speed for the spinner while the rinse water level is relatively high in order to establish a flush tumble cycle portion. With this arrangement, rinse water will be caused to flow from an outer tub of the machine through a frontal gap defined between an inner tub or spinner and the outer tub, as well as throughout a sealing boot extending between the outer tub and a front cabinet panel of the machine. This water flow and tumbling pattern causes items which have become lodged in the gap and boot areas to be flushed back into the spinner. Preferably, this flush tumble cycle portion is followed by a drain operation and a final spin cycle.

25 Claims, 4 Drawing Sheets

HORIZONTAL AXIS WASHING MACHINE INCORPORATING FLUSH TUMBLE CYCLE

This application claims benefit to U.S. provisional application Ser. No. 06/163,805, filed Nov. 5, 1999.

BACKGROUND OF THE INVENTION

1. Field of the Invention

The present invention pertains to the art of washing machines and, more particularly, to the incorporation of a flush tumble cycle in a horizontal axis washing machine.

2. Discussion of the Prior Art

Both vertical axis and horizontal axis washing machines are currently available in the marketplace for laundering articles of clothing. Due to significant improvements made in the art of horizontal axis washing machines in recent years, the demand for these types of machines are on the rise. Horizontal axis washing machines currently under production have the capability of utilizing less power and a reduced amount of water/detergent for a given washing operation over conventional vertical axis-type washing machines. Therefore, the operating costs associated with horizontal axis washing machines are typically lower than more conventional vertical axis washing machines. In addition, particularly due to the tumbling action imparted on articles of clothing being laundered, a horizontal axis washing machine generally has a greater ability to remove any tough stains on the clothing.

Obviously, there are a number of different structural features between these two types of known washing machines. However, both types of machines generally include a cabinet shell within which is suspended an outer tub. An inner tub or spinner is rotatably mounted within the outer tub, with annular side walls of the inner and outer tubs being arranged in a spaced, concentric fashion. Therefore, a gap is provided between the side walls of the inner and outer tubs, including at the open ends thereof. A pivotable door is secured to the cabinet shell for providing access to the inner tub in order to selectively load or unload laundry items. In addition, both types of machines function to wash clothes by saturating the clothes in a washing fluid and imparting various mechanical actions upon the clothes. At least during certain times in the washing operation, the washing fluid will be caused to flow between the inner and outer tubs. In each type of machine, at least one pump, having an input side which draws from the outer tub, is provided for draining the washing machine.

Of course, there are also some potential problems which must be overcome in the design of a horizontal axis washing machine that are simply not a consideration in the making of a vertical axis washing machine. For instance, given that the access opening to the inner tub in a horizontal axis washing machine can extend below the level of the washing fluid during operation of the machine, some of the fluid will be caused to naturally flow from the inner tub to the outer tub through the gap provided between the tubs at the front open ends thereof. Without being contained within the inner tub or spinner, other objects can also be caused to flow through this gap. Therefore, even certain rather small items, such as coins, buttons, hair pins and the like, inadvertently placed in the inner tub with the clothes to be laundered can get between the spinner and the outer tub. Typically, if the washing machine pump is capable of handling the foreign objects, there is no problem. However, if the objects are rather large in size or number, the pump may not be able to handle the objects. In this situation, the pump will clog and lead to problems for the consumer.

In solving this problem, it has been proposed to interpose a seal in the gap defined between the open frontal portions of the inner and outer tubs of a horizontal axis washing machine. For instance, in accordance with the disclosure in U.S. Pat. No. 5,979,195, a sealing device includes a first seal portion fixedly secured to a lower, inner wall portion of a front cover attached to the outer tub and a flexible, second seal portion extends toward and preferably, slidably contacts a balance ring provided about the open frontal portion of the inner tub. Due to the presence of the seal, the gap between the open frontal portions of the inner and outer tubs is bridged such that even rather small items cannot pass from the inner tub to the outer tub. However, the items can still become generally lodged in this area which is also undesirable.

Another area in which items can become lodged during operation of a horizontal axis washing machine is in a sealing boot generally provided between the outer tub and a front panel of the washing machine cabinet. More specifically, it is common in the art to provide a flexible sealing boot at this location to prevent the water/detergent from leaking from the overall cabinet. Such a known boot arrangement is disclosed, for example, in U.S. Pat. No. 3,276,229. Due to the flexibility and construction of such sealing boot arrangements, it is fairly common for a lower trough area to form in the boot between the open frontal portions of the tubs and the front cabinet panel. This trough area represents another zone outside the spinner that items can become lodged during operation of the washing machine. For instance, it is not too uncommon to find a sock, handkerchief or other small article in the trough of the boot at the completion of a washing cycle. That is, at some time during the washing cycle, the article is thrown from the spinner and comes to rest in the trough. Although the item can be easily removed at the end of the washing operation, it will likely be quite wet compared to the remainder of the clothing in the spinner which have gone through a final spin cycle.

Based on the above, there exists a need in the art for an arrangement which will effectively clear articles that become lodged either in the gap formed between the inner and outer tubs, the sealing boot or other areas outside the inner tub or spinner of a horizontal axis washing machine in order to assure that essentially all the items placed in the spinner for a particular washing operation are present in the spinner for a final spin cycle of a washing operation.

SUMMARY OF THE INVENTION

The present invention is particularly concerned with preventing articles, including small garments and foreign objects, from remaining lodged either in a flexible sealing device bridging a gap provided between inner and outer tubs or in a trough area defined by a sealing boot of the machine following the conclusion of a washing operation. In accordance with the most preferred form of the invention, a system is provided to cause a flushing operation in these areas in order to effectively dislodge any articles and re-deposit them back into the washing machine spinner, preferably before a final spin cycle of the washing operation.

In accordance with the most preferred form of the invention, the overall washing operation includes numerous rinse and spin cycles wherein at least a portion of one of the rinse cycles is performed at an increased rotational speed for the spinner while the rinse water level is relatively high. For instance, if the spinner tumbles at 50 rpm during a typical rinse cycle, the spinner is caused to tumble at a much higher rate, such as in the range of 80–100 rpm, while the tub is full of water. With this arrangement, the water will be distributed through the wash system. More particularly, the water will be caused to flow from the outer tub through the frontal gap between the inner and outer tubs and throughout the boot. This water flow and tumbling pattern will cause items which have fallen into these zones to be flushed back into the spinner. Preferably, this flush tumble cycle portion is followed by a drain operation and then a spin cycle.

Additional objects, features and advantages of the flush tumble cycle system of the present invention will become more fully apparent from the following detailed description of a preferred embodiment thereof when taken in conjunction with the drawings wherein like reference numerals refer to corresponding parts in the several views.

DETAILED DESCRIPTION OF THE PREFERRED EMBODIMENT

Figure 1:
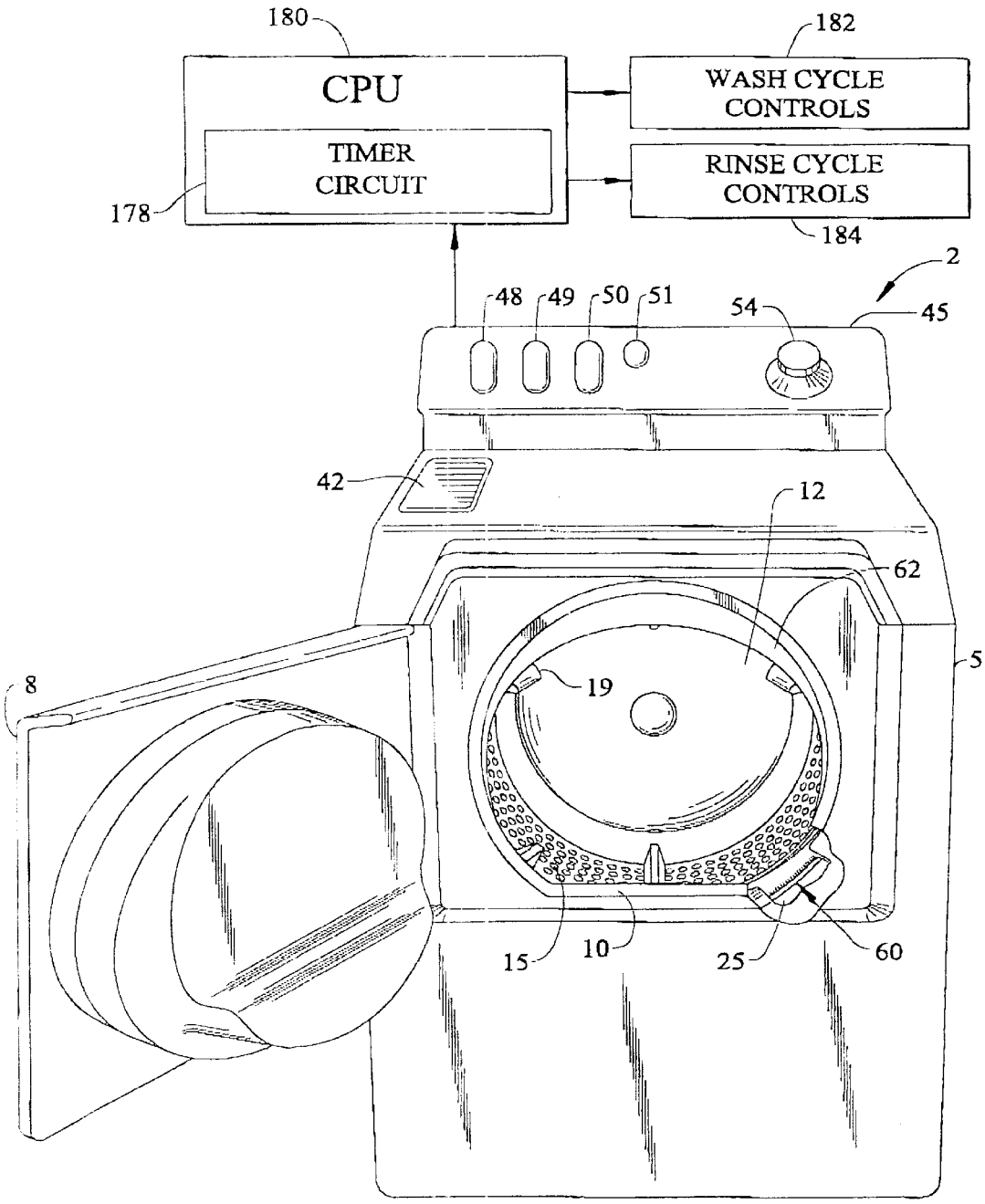
FIG. 1 is a partially cut-away, perspective view of a horizontal axis washing machine incorporating the flush tumble cycle feature of the present invention.

With initial reference to FIG. 1, an automatic horizontal axis washing machine incorporating the tumble flush feature of the present invention is generally indicated at 2. In a manner known in the art, washing machine 2 is adapted to be front loaded with articles of clothing to be laundered through a tumble-type washing operation. As shown, automatic washing machine 2 incorporates an outer cabinet shell 5 provided with a front door 8 adapted to extend across an access opening 10. Front door 8 can be selectively pivoted to provide access to an inner tub or spinner 12 that constitutes a washing basket within which the articles of clothing are laundered.

Figure 3:
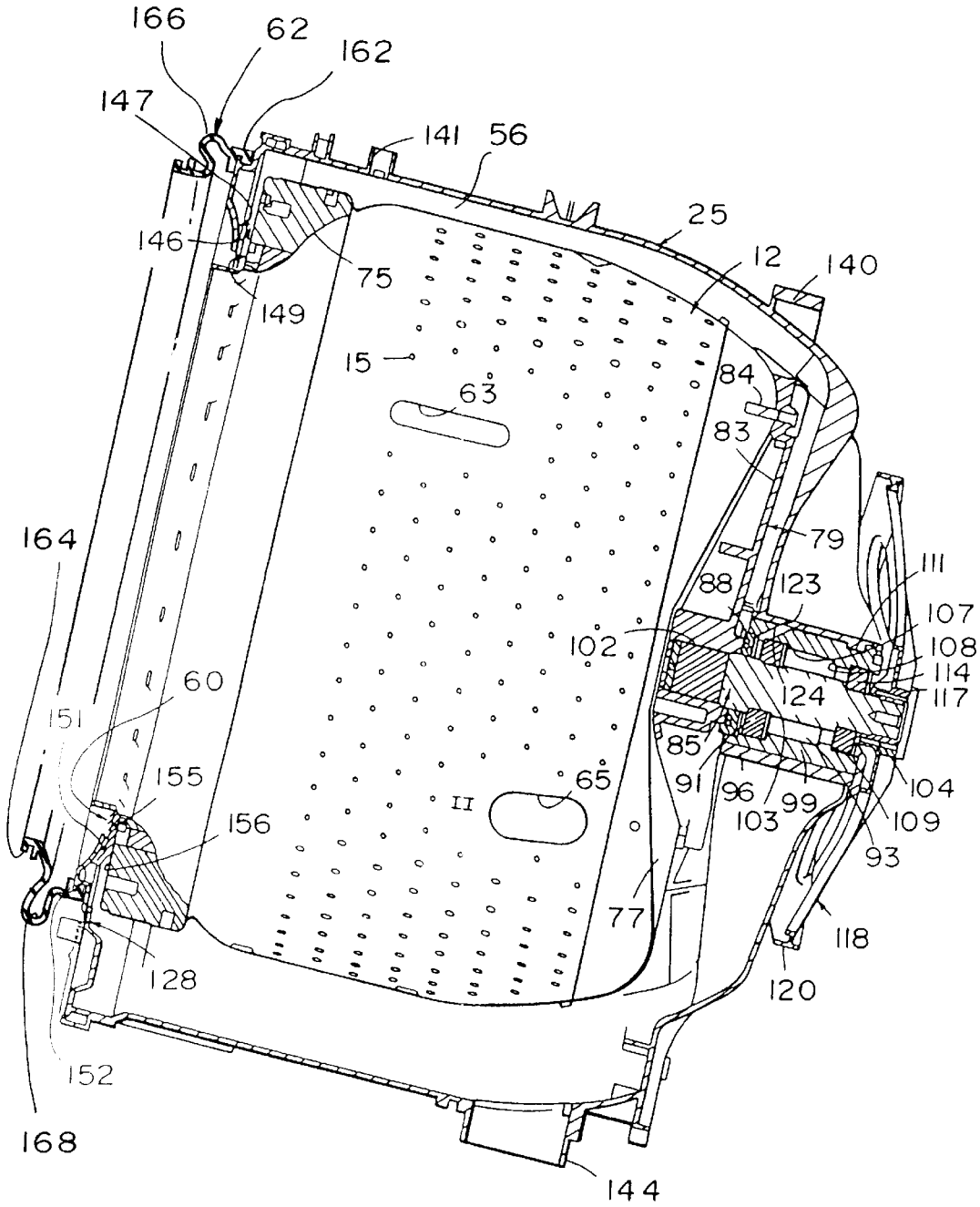
FIG. 3 is a cross-sectional view of the internal components of FIG. 2 in an assembled state.

As is known in the art, inner tub 12 is formed with a plurality of holes 15 and multiple, radially inwardly projecting fins or blades 19 are fixedly secured to inner tub 12. Inner tub 12 is mounted for rotation within an outer tub 25, which is supported through a suspension mechanism (not shown) within cabinet shell 5. Inner tub 12 is mounted within cabinet shell 5 for rotation about a generally horizontal axis. Actually, the rotational axis is angled slightly downwardly and rearwardly as generally represented in FIG. 3. Although not shown, a motor, preferably constituted by a variable speed, reversible electric motor, is mounted within cabinet shell 5 and adapted to drive inner tub 12. More specifically, inner tub 12 is rotated during both wash and rinse cycles such that articles of clothing placed therein actually tumble through either water, water/detergent or another washing fluid supplied within inner tub 12. Given that inner tub 12 is provided with at least the plurality of holes 15, the water or water/detergent can flow between the inner and outer tubs 12 and 25. A pumping system (not shown) is provided to control the level of washing fluid within machine 2, with one pump particularly controlling the timed draining of the fluid from the outer tub 25.

The general manner in which the automatic washing machine 2 of FIG. 1 operates is well known in the art and is not considered an aspect of the present invention. Therefore, a complete description of its operation will not be described here. However, for the sake of completeness, automatic washing machine 2 is also shown to include an upper cover 42 that provides access to an area for adding detergent, softeners and the like. In addition, an upper control panel 45, including various selector buttons 48–51 and a control knob 54, is provided for manually establishing a desired washing operation in a manner known in the art.

Figure 2:
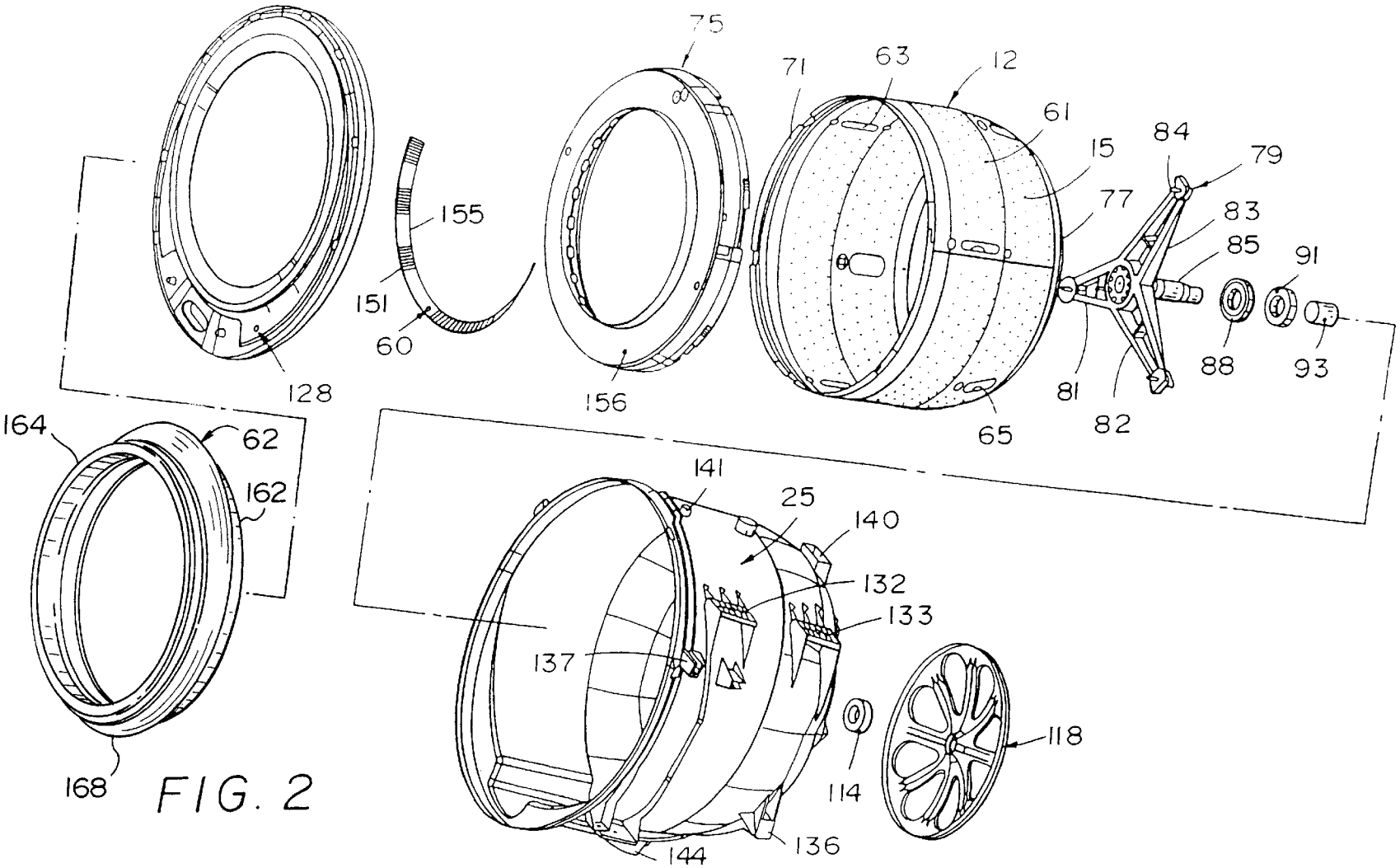
FIG. 2 is an exploded view of various internal components of the washing machine of FIG. 1.

In order to allow inner tub 12 to freely rotate within outer tub 25 during a given washing operation, inner tub 12 is spaced concentrically within outer tub 25 in the manner which will be detailed more fully below. This spacing establishes an annular gap 56 between the inner and outer tubs 12 and 25. As will be discussed filly below, an axial gap is also created at the open frontal portions of inner and outer tubs 12 and 25. During operation of washing machine 2, the washing fluid can flow through gap 56 from inner tub 12 into outer tub 25. In addition, small objects can also flow into the outer tub 25 through the axial gap. Unfortunately, it has been found in the past that some objects flowing through the axial gap can end up clogging or otherwise disrupting the normal operation of the pumping system, thereby leading to the need for machine repairs. In order to remedy this situation, it has been heretofore proposed to incorporate a flexible sealing device, generally indicated at 60 in FIGS. 1 and 3, which functions to bridge this gap between inner and outer tubs 12 and 25 to prevent such objects from flowing into the outer tub 25. Further provided as part of washing machine 2 in a manner known in the art is a sealing boot 62 which extends generally between outer tub 25 and a frontal panel portion (not separately labeled) of cabinet shell 5. Reference now will be made to FIGS. 2 and 3 in describing the preferred mounting of inner tub 12 within outer tub 25 and the arrangement of both sealing device 60 and sealing boot 62 as the tumble cycle feature of the present invention is related to the presence of one or more of these structural elements.

Inner tub 12 has an annular side wall 67 and an open front rim 71 about which is secured a balance ring 75. In the preferred embodiment, balance ring 75 is injection molded from plastic, such as polypropylene, with the balance ring 75 being preferably mechanically attached to rim 71. Inner tub 12 also includes a rear wall 77 to which is fixedly secured a spinner support 79. More specifically, spinner support 79 includes a plurality of radially extending arms 81–83 which are fixedly secured to rear wall 77 by means of screws 84 or the like. Spinner support 79 has associated therewith a driveshaft 85. Placed upon driveshaft 85 is an annular lip seal 88. Next, a first bearing unit 91 is press-fit onto driveshaft 85. Thereafter a bearing spacer 93 is inserted upon driveshaft 85.

The mounting of inner tub 12 within outer tub 25 includes initially placing the assembly of inner tub 12, balance ring 75, spinner support 79, lip seal 88, first bearing unit 91 and bearing spacer 93 within outer tub 25 with driveshaft 85 projecting through a central sleeve 96 formed at the rear of outer tub 25. More specifically, a metal journal member 99 is arranged within central sleeve 96, with central sleeve 96 being preferably molded about journal member 99. Therefore, driveshaft 85 projects through journal member 99 and actually includes first, second and third diametric portions 102–104. In a similar manner, journal member 99 includes various diametric portions which define first, second and third shoulders 107–109. Journal member 99 also includes an outer recess 111 into which the plastic material used to form outer tub 25 flows to aid in integrally connecting journal member 99 with outer tub 25.

As best shown in FIG. 3, the positioning of driveshaft 85 in journal member 99 causes each of annular lip seal 88, first bearing 91 and bearing spacer 93 to be received within journal member 99. More specifically, annular lip seal 88 will be arranged between first diametric portion 102 of driveshaft 85 and journal member 99. First bearing unit 91 will be axially captured between the juncture of first and second diametric portions 102 and 103, as well as first shoulder 107. Bearing spacer 93 becomes axially positioned between first bearing unit 91 and second shoulder 108 of journal member 99. Thereafter, a second bearing unit 114 is placed about driveshaft 85 and inserted into journal member 99, preferably in a press-fit manner, with second bearing unit 114 being seated upon third shoulder 109. At this point, a hub 117 of a spinner pulley 118 is fixedly secured to a terminal end of driveshaft 85 and axially retains second bearing unit 114 in position. Spinner pulley 118 includes an outer peripheral surface 120 which is adapted to be connected to a belt driven in a controlled fashion by the reversible motor mentioned above in order to rotate inner tub 12 during operation of washing machine 2. In order to provide lubrication to lip seal 88, central sleeve 96 is formed with a bore 123 that is aligned with a passageway 124 formed in journal member 99.

Outer tub 25 has associated therewith a tub cover 128. More specifically, once inner tub 12 is properly mounted within outer tub 25, tub cover 128 is fixedly secured about the open frontal zone of outer tub 25. Although the materials for the components discussed above may vary without departing from the spirit of the invention, outer tub 25, balance ring 75 and tub cover 128 are preferably molded from plastic, while inner tub 12 is preferably formed of stainless steel. Again, these materials can vary without departing from the spirit of the invention. For example, inner tub 12 could also be molded of plastic.

Outer tub 25 is best shown in FIG. 2 to include a plurality of balance weight mounting gusset platforms 132 and 133, a rear mounting boss 136 and a front mounting support 137. It should be realized that commensurate structure is provided on an opposing side portion of outer tub 25. In any event, balance weight mounting platforms 132 and 133, mounting boss 136, mounting support 137 and further mounting boss 140 are utilized in mounting outer tub 25 within cabinet shell 5 in a suspended fashion. Again, the specific manner in which outer tub 25 is mounted within cabinet shell 5 is not considered part of the present invention, so it will not be described further herein. Outer tub 25 is also provided with a fluid inlet port 141 through which washing fluid, i.e., either water, water/detergent or the like, can be delivered into outer tub 25 and, subsequently, into inner tub 12 in the manner discussed above. Furthermore, outer tub 25 is formed with a drain port 144 which is adapted to be connected to a pump for draining the washing fluid from within inner and outer tubs 12 and 25 during certain cycles of a washing operation.

As best illustrated in FIG. 3, inner tub 12 is entirely spaced from outer tub 25 for free rotation therein. This spaced relationship also exists at the front ends of inner and outer tubs 12 and 25 such that an annular gap 146 is defined between an open frontal zone 147 of outer tub 25 and an open frontal portion 149 associated with balance ring 75. It is through a lower section of gap 146 that washing fluid can also flow from within inner tub 12 to outer tub 25. With this fluid flow, other items including buttons, hair pins and the like inadvertently placed in inner tub 12 with the clothes to be washed, can get into outer tub 25. Typically, the pump associated with drain port 144 is capable of managing certain objects without any problem. However, depending upon the size and number of the objects, the pump may not be able to handle the objects, whereby the pump will clog or at least the normal operation thereof will be disrupted.

Because of this problem, the flexible sealing device 60 is mounted so as to bridge gap 146 between inner and outer tubs 12 and 25 and, specifically, between balance ring 75 and tub cover 128. Gap 146 is required because of deflections between inner tub 12 and outer tub 25 during operation of washing machine 2. Sealing device 60 bridges gap 146 to prevent small items from passing through, but sealing device 60 is flexible so as to accommodate changes in the size of gap 146 resulting from deflections during operation. Sealing device 60 includes a first seal portion 151 that is fixed or otherwise secured to a rear or inner surface 152 of tub cover 128 and a second, flexible seal portion 155, such as brush bristles or a plastic film, which projects axially across gap 146 and is placed in close proximity and most preferably in sliding contact with a front or outer surface 156 of balance ring 75. As is also known in the art, sealing boot 62 includes an inner annular end 162 which is fixed sealed to tub cover 128, an outer annular end 164 which is fixed to the front cabinet panel (not separately labeled) of cabinet shell 5 and a central, flexible portion 166. As perhaps best shown in FIG. 3, flexible portion 166 actually defines a lower trough 168.

Until this point, the basic structure of washing machine 2 is known in the art and has been described both for the sake of completeness and to establish the need and advantages of the flush tumble system of the present invention which will be detailed below. However, at this point, it should be also realized that small articles, such as socks, handkerchiefs, scarves, certain undergarments, etc., can become lodged in trough 168 during operation of washing machine 2. The present invention particularly addresses the dislodging of these articles and the manner in which the articles are directed back into the inner tub 12, preferably prior to a final spin cycle of the washing operation.

Figure 4:
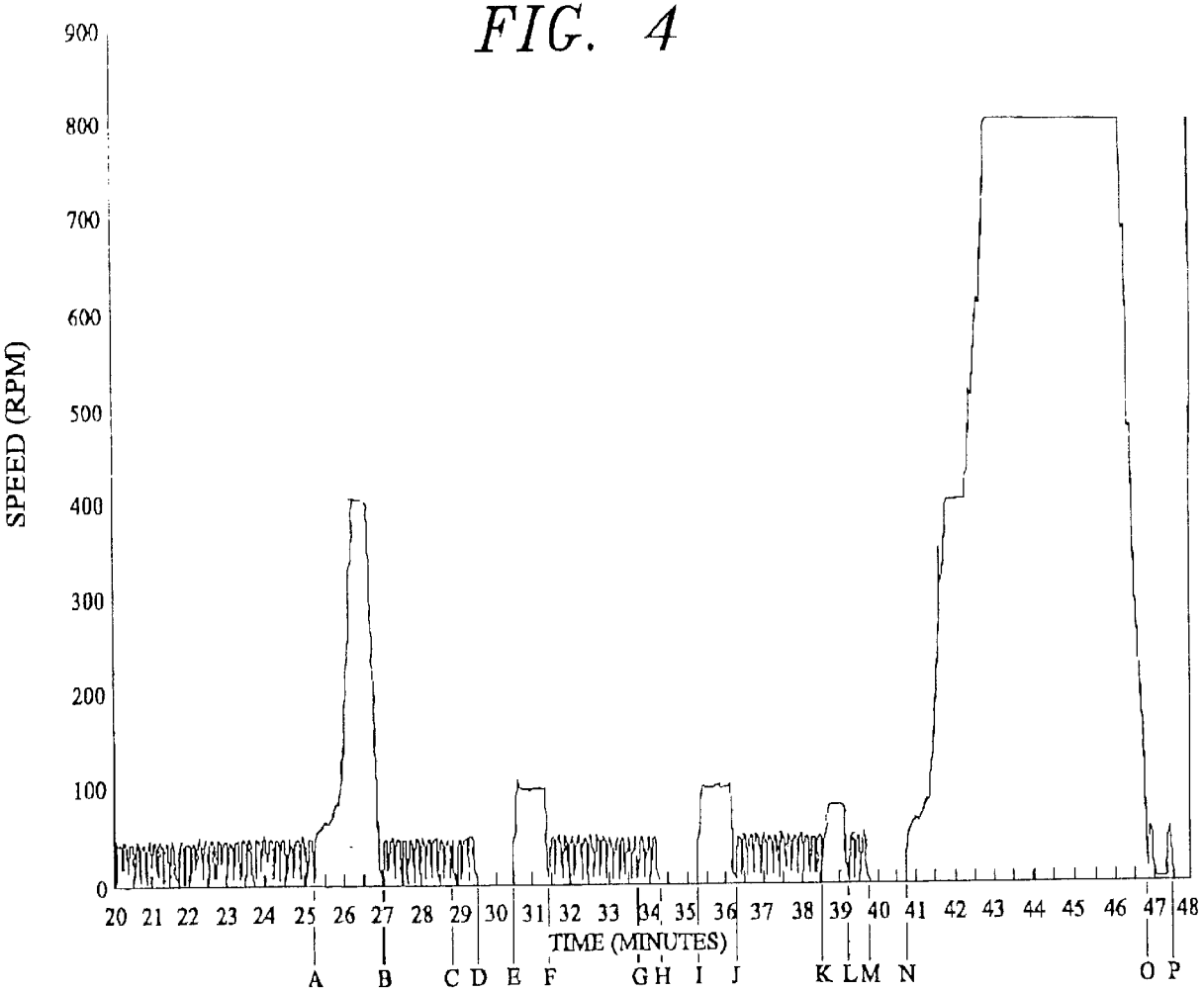
FIG. 4 is a graph illustrating various cycles experienced by the washing machine during a typical washing operation in accordance with the present invention.

During a normal washing operation, automatic washing machine 2 will proceed through a main wash cycle and a predetermined number of rinse cycles. More specifically as illustrated in the graph of FIG. 4, automatic washing machine 2 will preferably proceed through a single wash cycle and three rinse cycles. During the main wash cycle, the terminal end of which is shown in the graph of FIG. 4, a preset amount of water is added to any detergent or other washing solution supplied in the areas beneath cover 42 and inner tub or spinner 12 is driven to tumble articles of clothing through the resulting solution. In the version shown for automatic washing machine 2, the tumbling period is determined by a timer circuit 178 incorporated within a CPU 180 which, in turn, signals the wash and rinse cycle controls as indicated at 182 and 184 in FIG. 1. Periodically, it is preferable to alter the rotational direction of inner tub 12 during this period to vary the tumbling pattern.

After the wash cycle tumbling time period has elapsed, a drain cycle is initiated with a continued tumbling action. In the preferred embodiment, this tumble drain period lasts approximately 90 seconds. Following the tumble drain, inner tub 12 is subjected to a spin mode which is shown between point A and B in FIG. 4. In the preferred embodiment, inner tub 12 spins at approximately 400 RPM for approximately two minutes. At this point, the water/detergent solution has been substantially removed from within inner tub 12, although the articles of clothing will certainly still possess a certain percentage of the solution. Next, the articles of clothing are subjected to the predetermined number of rinse cycles wherein inner tub 12 is filled to a predetermined level with water and placed in a rinse cycle tumble pattern. In the most preferred form, three rinse cycles are provided. In general, each of the rinse cycles sequentially incorporate a rinsing tumble mode (see cycle portions B–C, F–G and J–K in FIG. 4), followed by a tumble drain (see cycle portions C–D, G–H and L–M), a pause drain (see cycle portions D–E, H–I and M–N) and then a rinse cycle spin mode (see cycle portions E–F, I–J and N–O). Thereafter, a final draining occurs and inner tub 12 is allowed to coast to a stop position (portion O–P) and the washing operation is completed.

At this point, it should again be realized that the specific washing operation described above, including the specific speeds and times established for the various modes of operation as clearly represented in FIG. 4, are presented for the sake of completeness only and should not be considered limiting to the present invention. Instead, it is the manner in which the control system of the present invention alters the conventional washing operation to incorporate a flush tumble cycle portion which is important to the present invention.

As is known in the art, horizontal axis washing machines tend to utilize much less water than more conventional vertical axis washing machines and water is only in the lower portions of inner and outer tubs 12 and 25. However, during the wash cycle portion of the overall operation and even to the first spin cycle, i.e., through point B shown in FIG. 4, it has been found that articles have been thrown out of inner tub 12. These articles generally become lodged at either sealing device 60 or, perhaps more importantly, in trough 168 of sealing boot 62. In order to dislodge these articles and re-deposit them back into inner tub 12 sometime prior to the completion of the washing operation, preferably before the final spin cycle (i.e., cycle portion N–O) and, most preferably, before the drain cycle periods (cycle portions L–M and M–N) prior to the final spin cycle, CPU 180 causes the initiation of a flush tumble cycle portion (see portion K–L in FIG. 4) as part of the final rinse cycle. During the flush tumble cycle portion, the rotation of inner tub 12 is caused to increase from a typical 50 rpm rinse cycle speed to in the order of 80–100 rpm while inner tub 12 still contains the full amount of rinse water.

This flush tumble action causes the water to be distributed throughout the overall wash system which, in turn, advantageously causes some internal surface washing for machine 2. More importantly, water is caused to flow from the outside of inner tub 12, past sealing device 60 at gap 146 to dislodge any article caught in this region. Also, the water flushes out any articles lodged in trough 168 of boot 62 and causes these articles to be re-deposited back into inner tub 12.

Although described with respect to a preferred embodiment of the invention, it should be readily understood that various changes and/or modifications can be made to the invention without departing from the spirit thereof. For instance, the particular timing of the flush tumble cycle relative to the other cycle portions of the overall washing operation could readily vary in accordance with the invention. In addition, more than one flush tumble cycle could be initiated. In general, it should be realized that the invention is concerned with flushing out the zones of a horizontal axis washing machine where articles can become inadvertently lodged such that the particular embodiment described should be considered illustrative and not restrictive of the invention.

I claim:

1. A washing machine for laundering articles by imparting mechanical actions upon the articles within an inner tub, mounted for rotation about a substantially horizontal axis within an outer tub inside a cabinet of the machine, during a washing operation that includes wash, rinse and drain cycles comprising:

a seal member extending between at least one of the inner and outer tubs, and the outer tub and the cabinet; and a control system for altering the mechanical actions imparted upon the articles of clothing during a latter stage of the washing operation to establish a flush cycle wherein articles, which become lodged at the seal member during an earlier stage of the washing operation, are re-deposited back into the inner tub.

2. The washing machine according to claim 1, wherein the flush cycle defines a portion of the rinse cycle.

3. The washing machine according to claim 2, wherein the flush cycle is confined to an intermediate portion of the rinse cycle.

4. The washing machine according to claim 2, wherein the control system alters a rotational speed of the inner tub during the portion of the rinse cycle to establish the flush cycle.

5. The washing machine according to claim 4, further comprising: a drive mechanism for rotating the inner tub during at least the rinse cycle, said control system functioning to increase the rotational speed of the inner tub, through the drive mechanism, from a first speed to a second speed during the flush cycle.

6. The washing machine according to claim 5, wherein the control system establishes an amount of rinse water for the rinse cycle and said flush cycle is carried out with said amount of rinse water.

7. The washing machine according to claim 2, wherein the washing operation includes a plurality of rinse cycles, said flush cycle being defined by a portion of a final one of the plurality of rinse cycles.

8. The washing machine according to claim 7, wherein the flush cycle is confined to an intermediate portion of the final one of the plurality of rinse cycles.

9. The washing machine according to claim 1, wherein the seal member defines a trough between the outer tub and the cabinet.

10. The washing machine according to claim 9, further comprising: an additional seal member extending between the inner tub and the outer tub.

11. An automatic washing machine for laundering articles through a washing operation comprising:

a cabinet;

an outer tub mounted within the cabinet;

an inner tub mounted for rotation within the outer tub, said inner tub being adapted to receive a supply of water and articles to be laundered;

a seal member arranged between at least two of the cabinet, outer tub and inner tub; and a control system for establishing at least wash, rinse and drain cycles, as well as a flush cycle, as part of the washing operation wherein, during the flush cycle, water is directed across the seal member to cause articles, which become lodged at the seal member during an earlier stage of the washing operation, to be re-deposited back into the inner tub.

12. The washing machine according to claim 11, wherein the flush cycle defines a portion of the rinse cycle.

13. The washing machine according to claim 12, wherein the flush cycle is confined to an intermediate portion of the rinse cycle.

14. The washing machine according to claim 12, wherein the control system alters a rotational speed of the inner tub during the portion of the rinse cycle to establish the flush cycle.

15. The washing machine according to claim 14, further comprising: a drive mechanism for rotating the inner tub during at least the rinse cycle, said control system functioning to increase the rotational speed of the inner tub, through the drive mechanism, from a first speed to a second speed during the flush cycle portion.

16. The washing machine according to claim 15, wherein the control system establishes an amount of rinse water for the rinse cycle and said flush cycle is carried out with said amount of rinse water.

17. The washing machine according to claim 12, wherein the washing operation includes a plurality of rinse cycles, said flush cycle being defined by a portion of a final one of the plurality of rinse cycles.

18. The washing machine according to claim 17, wherein the flush cycle is confined to an intermediate portion of the final one of the plurality of rinse cycles.

19. The washing machine according to claim 11, wherein the seal member defines a trough between the outer tub and the cabinet.

20. The washing machine according to claim 19, further comprising: an additional seal member extending between the inner tub and the outer tub.

21. In an automatic washing machine for laundering articles within an inner tub, which is adapted to rotate about a substantially horizontal axis within both an outer tub and a cabinet, during a washing operation including wash, rinse and drain cycles, a method of re-depositing articles which have become displaced outside of the inner tub during the washing operation, back into the inner tub comprising: operating the washing machine in a flush cycle stage, during a latter stage of the washing operation, wherein water is directed across a seal member, arranged between at least two of the cabinet, outer tub and inner tub, to cause articles, lodged at the seal member, to be re-deposited back into the inner tub.

22. The method according to claim 21, wherein the flush cycle stage is defined by a portion of the rinse cycle.

23. The method according to claim 22, wherein the flush cycle stage is confined to an intermediate portion of the rinse cycle.

24. The method according to claim 23, wherein the inner tub is caused to rotate at a higher speed in the flush cycle stage than in a remainder of the rinse cycle.

25. The method according to claim 24, further comprising:

establishing a rinse water level for the rinse cycle; and carrying out the flush cycle stage at the rinse water level.

* * * * *